US006213074B1

(12) United States Patent
Freese

(10) Patent No.: US 6,213,074 B1
(45) Date of Patent: Apr. 10, 2001

(54) INTERNAL COMBUSTION ENGINE WITH WEDGE-SHAPED CYLINDER HEAD AND INTEGRAL INTAKE MANIFOLD AND ROCKER COVER THEREFOR

(75) Inventor: Charles Edwin Freese, Westland, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/351,115

(22) Filed: Jul. 13, 1999

(51) Int. Cl.[7] ..... F01M 9/10

(52) U.S. Cl. ..... 123/90.38; 123/198 E; 123/195 C

(58) Field of Search ..... 123/90.38, 184.21, 123/184.31, 184.42, 195 C, 198 E, 568.12, 568.17

(56) References Cited

U.S. PATENT DOCUMENTS 3,949,715 * 4/1976 Faix et al. ..... 123/184.42
3,973,548 * 8/1976 Celli ..... 123/195 C
4,213,440 * 7/1980 Abe et al. ..... 123/195 C
4,257,369 * 3/1981 Abe et al. ..... 123/198 E
4,267,812 * 5/1981 Aula et al. ..... 123/568.12
4,471,731 * 9/1984 Kasting et al. ..... 123/90.38
4,601,267 * 7/1986 Kronich ..... 123/90.38
5,309,885 * 5/1994 Rawlings et al. ..... 123/184.21
5,323,745 * 6/1994 Sato et al. ..... 123/195 C
6,089,199 * 7/2000 Lohr et al. ..... 123/90.38
6,092,498 * 7/2000 Lohr et al. ..... 123/90.38
6,095,105 * 8/2000 Lohr et al. ..... 123/90.38
6,102,014 * 8/2000 Donaldson ..... 123/568.12

* cited by examiner

*Primary Examiner*—Tu Ba Hoang
*Assistant Examiner*—Fadi H. Dahbour
(74) *Attorney, Agent, or Firm*—Bill C. Panagos

(57) ABSTRACT

An internal combustion engine including an engine block having a pair of cylinder banks arranged in a V-shaped configuration such that each of the pair of cylinder banks presents a top wall disposed at an acute angle relative to the horizontal. Each cylinder bank includes a plurality of cylinders. A pair of cylinder heads are associated with each pair of cylinder banks. Each of the cylinder heads includes upper and lower walls disposed at an angle relative to each other such that each cylinder head is substantially wedge-shaped in cross-section. Each cylinder head is mounted to the engine block such that the upper wall of each cylinder head is substantially parallel to the horizontal. A pair of exhaust manifolds are mounted to each pair of cylinder heads. A single, integrated intake manifold and rocker cover is mounted to the horizontal upper wall of the pair of cylinder heads. The integrated manifold and rocker cover provide intake air to the cylinders in each of the pair of cylinder banks through the pair of cylinder heads and recirculates exhaust gas from the exhaust manifold to each of the cylinders in the pair of cylinder banks.

5 Claims, 2 Drawing Sheets

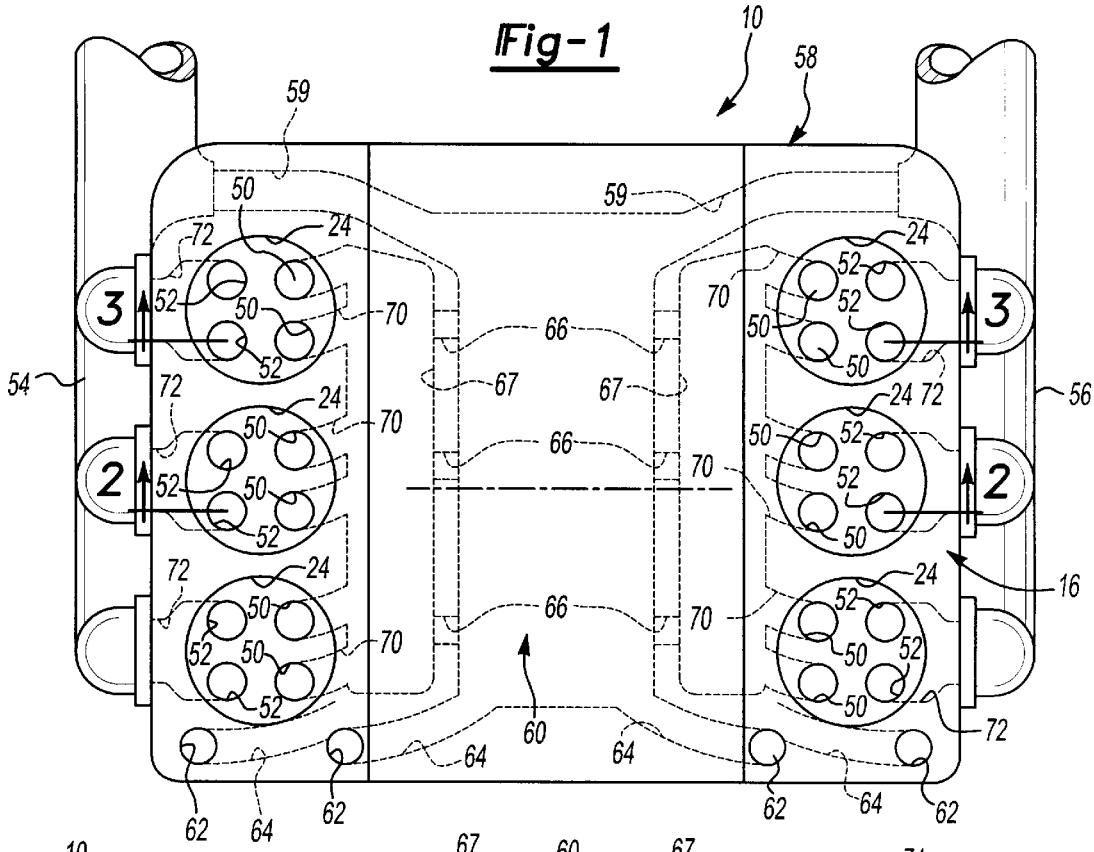
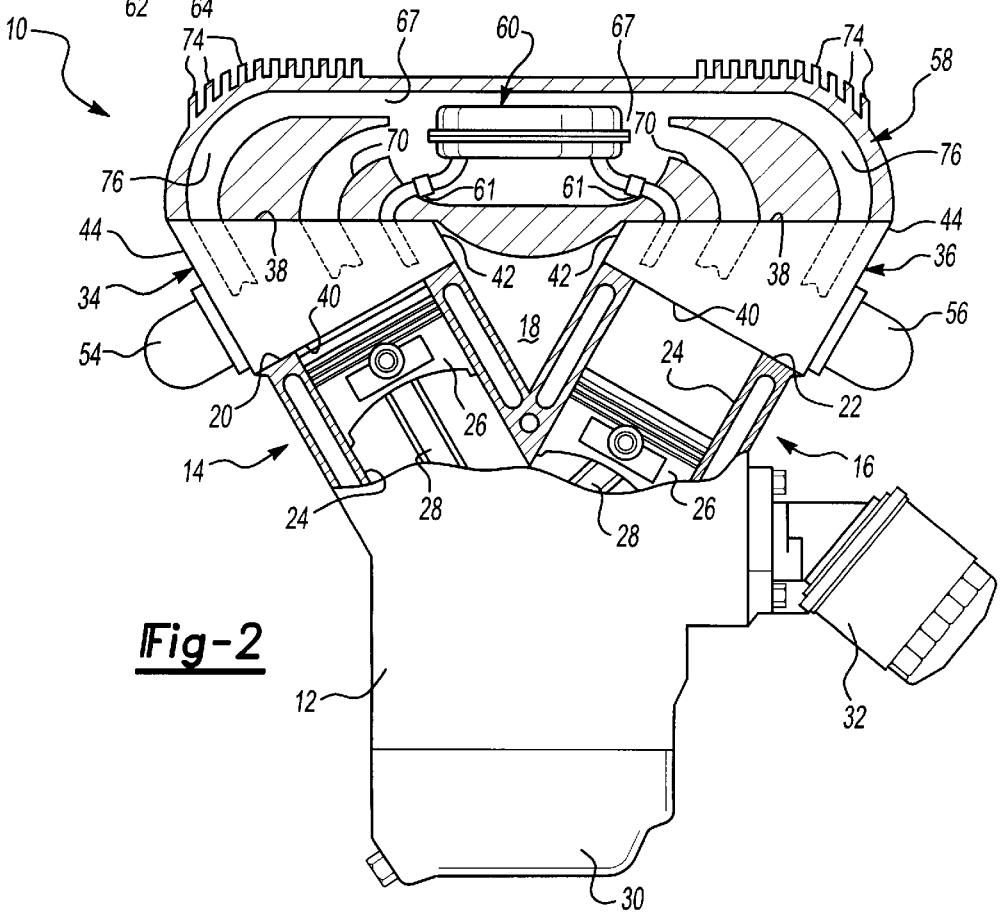
Fig-2

INTERNAL COMBUSTION ENGINE WITH WEDGE-SHAPED CYLINDER HEAD AND INTEGRAL INTAKE MANIFOLD AND ROCKER COVER THEREFOR

BACKGROUND OF THE INVENTION

1. Field of the Invention

The present invention is generally directed toward internal combustion engines and, more specifically, to an internal combustion engine having a V-shaped engine block, wedge-shaped cylinder head and a single, integrated intake manifold and rocker cover.

2. Description of the Related Art

Internal combustion engines known in the related art may include, among other basic components, a cast engine block having a pair of cylinder banks arranged in a V-shaped configuration, a pair of cylinder heads associated with each cylinder bank mounted to the engine block and a pair of valve covers fastened to each cylinder head. Each bank of cylinders is usually serviced by a dedicated intake manifold mounted to each cylinder head. A plurality of pistons are reciprocated in cylinders formed in each cylinder bank of the engine block. Similarly, a plurality of valves supported in each cylinder head are opened and closed via rocker arms, cams or some other mechanism to provide fluid communication between the cylinders and intake and exhaust manifolds. Fuel is combusted within the cylinders to reciprocate the pistons which, in turn, act on a crankshaft from which power may be translated to drive an automotive vehicle or any number of other devices.

In the case of compression ignition or diesel engines, the fuel/air mixture is delivered at relatively high pressures via fuel injector assemblies. Presently, conventional injectors are delivering this mixture at pressures as high as 32,000 psi. These are fairly high pressures and have required considerable engineering attention to a number of engine components to ensure the structural integrity, good sealing properties and the effective atomization of the fuel within the combustion chamber.

In addition, modern, high speed, direct injection diesel engines often employ cylinder heads having four valves per cylinder to meet challenging performance, noise and emission targets. However, four-valve configurations typically present difficult packaging challenges for small bore, direct injection, diesel engines. As higher engine efficiencies are targeted, engine designers are pushing engines to achieve higher peak firing pressures, necessitating higher head bolt clamp loads. This requirement further complicates the cylinder head and intake port packaging approach.

Many diesel engines adapted for automotive applications in North America will require lower valve train costs to compete effectively with gasoline engines. This factor, among other things, has resulted in the use of an overhead valve (OHV) configuration in the cylinder head, rather than the more generally accepted single overhead camshaft (SOHC) or dual overhead cam shaft (DOHC) design. Especially when employed in connection with V-block engines, overhead valve configurations achieve the necessary automotive diesel-rated speeds with sufficient valve train stiffness, while at the same time resulting in lower overall costs. Further, overhead valve configurations reduce total friction when compared with single or double overhead cam configurations. However, engines which employ overhead valve configurations also require push rods to actuate the valve rocker. Push rods present an additional space claim in the already crowded cylinder head envelope.

In essence, then, the modem diesel engine must provide a substantial fuel economy advantage while meeting evermore stringent emission regulations which are imposed on smaller, more compact diesel engines. However, increasing demands for greater fuel economy, cleaner burning, fewer emissions, $NO_x$ and noise control in addition to better component packaging, have placed, and will continue to place, even higher demands on the engine. Thus, there is an ongoing need in the art for better control over these various parameters in a cost-effective manner.

SUMMARY OF THE INVENTION

The present invention overcomes these disadvantages in the related art in an internal combustion engine including an engine block having a pair of cylinder banks arranged in a V-shaped configuration. Each of the pair of cylinder banks presents a top wall disposed at an acute angle relative to the horizontal and plurality of cylinders disposed spaced from one another and longitudinally aligned within each cylinder bank. A pair of cylinder heads are associated with each pair of cylinder banks. Each of the cylinder heads includes upper and lower walls disposed at an angle relative to each other such that each cylinder head is substantially wedge-shaped in cross-section. The cylinder heads are mounted to the engine block such that the lower wall of each cylinder head seals the opposing top wall of the associated cylinder bank and closes the open ends of the cylinders and such that the upper wall of each cylinder head is substantially parallel to the horizontal. A pair of exhaust manifolds are mounted to each of the pair of cylinder heads. A single, integrated intake manifold and rocker cover is mounted to the horizontal upper walls of the cylinder heads. The integrated manifold and rocker cover provides intake air to the cylinders in each of the cylinder banks through the cylinder heads and recirculates exhaust gas from the exhaust manifold to each of the cylinders in the cylinder banks.

The present invention facilitates efficient engine component packing objectives by combining a single intake manifold for servicing both cylinder banks with a single rocker cover. Accordingly, the present invention eliminates the need for separate intake manifolds, gaskets, exhaust gas recirculation (EGR) cooler housings and certain on-board plumbing associated with externally mounted EGR valves. Further, the use of a wedge-shaped cylinder head design for a V-block engine provides a substantially horizontal mounting face for the single, integrated intake manifold and rocker cover. With this design, the intake manifold supplies intake air to the cylinders from above. Further, the wedge-shaped cylinder head provides vertical access into the intake port of the cylinder.

Accordingly, one advantage of the present invention is that it eliminates a number of components as well as plumbing, gaskets, brackets and fasteners associated with separate intake manifolds for each cylinder head, separate rocker covers and EGR cooling apparatuses.

Another advantage of the present invention is that the wedge-shaped cylinder heads present a substantially horizontal mounting surface for the intake manifold. This feature reduces stack up variability and avoids side loads on the cylinder head and block.

Still another advantage of the present invention is that the wedge-shaped cylinder heads provide added flexibility to optimize intake port geometry with a low loss top entry intake port. Further, vertical intake air entry into the cylinder head may be used to achieve additional tumble within the combustion chamber.

BRIEF DESCRIPTION OF THE DRAWINGS

Other advantages of the invention will be readily appreciated as the same becomes better understood by reference to the following detailed description when considered in connection with the accompanying drawings, wherein:

FIG. 1 is a top view of the V-block internal combustion engine of the present invention.

FIG. 2 is a cross-sectional side view of a V-block internal combustion engine including wedge-shaped cylinder heads and a single, integrated intake manifold and rocker cover taken substantially along lines 2—2 of FIG. 1.

DETAILED DESCRIPTION OF THE PREFERRED EMBODIMENT(S)

Figure 3:
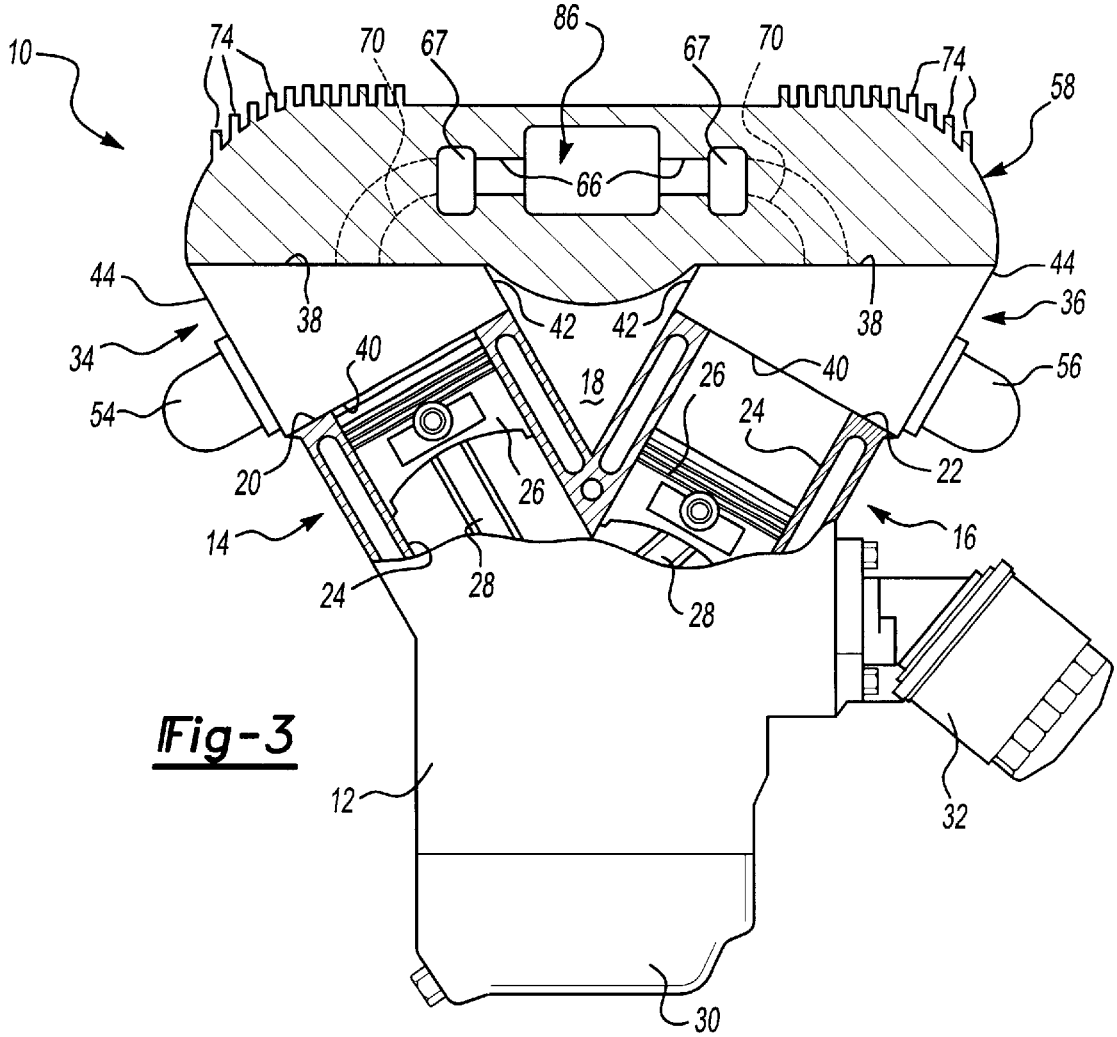
FIG. 3 is a cross-sectional side view of a V-block internal combustion engine including wedge-shaped cylinder heads and a single, integrated intake manifold and rocker cover taken substantially along lines 3—3 of FIG. 1.

Referring now to FIGS. 1 and 2, an internal combustion engine is generally indicated at 10. In the preferred embodiment, the engine 10 is a compression ignition, or diesel engine, but those having ordinary skill in the art will appreciate that the engine 10 may also be a spark ignition engine. The engine 10 includes a cast engine block 12 having a pair of cylinder banks 14, 16 arranged in a V-shaped configuration so as to define a valley or plenum 18 therebetween. Because of this V shape, each of the cylinder banks 14, 16 present a top wall or "fire deck" 20, 22, respectively, which is disposed at an acute angle relative to a horizontal plane when viewed in cross-section as shown in FIGS. 2 and 3. Further, each cylinder bank 14, 16 includes a plurality of open-ended cylinders 24 disposed spaced from one another and longitudinally aligned within each cylinder bank 14, 16.

A piston 26 is reciprocally supported in each of the cylinders 24. Each piston 26 is connected by a connecting rod 28 to a crankshaft (not shown) journaled in a conventional fashion in the lower portion of the cylinder block 12. Fuel is combusted within the cylinders 24 which reciprocates the pistons 26 which, in turn, act on the crankshaft from which power may be translated to drive an automotive vehicle, or any number of other devices. An oil pan 30 is secured below the engine block 12 and provides a sump for oil used in lubricating the various parts of the engine. An oil filter 32 is mounted to the engine block 12 to filter contaminants which are picked up by the oil during lubrication.

As best shown in FIGS. 2 and 3, a pair of cylinder heads, generally indicated at 34 and 36, are associated with the pair of cylinder banks 14, 16, respectively. Each of the cylinder heads 34, 36 include upper and lower walls 38, 40. The upper and lower walls 38, 40 are disposed at angles relative to each other such that each cylinder head 34, 36 is substantially wedge-shaped in cross-section. Furthermore, each cylinder head 34, 36 includes inner and outer side walls 42, 44, respectively, and front and rear walls (not indicated by reference numerals) which extend between the inner and outer side walls 42, 44. The inner and outer walls 42, 44, as well as the front and rear walls all extend between the upper and lower walls 38, 40.

The cylinder heads 34, 36 are mounted to the engine block 12 such that the lower wall 40 of each of the cylinder heads 34, 36 seals the opposing top wall 20, 22 of the associated cylinder bank 14, 16 so as to close the open end of the cylinders 24. Furthermore, the cylinder heads 34, 36 are mounted to the engine block 12 such that the upper wall 38 of each of the cylinder heads 34, 36 is substantially parallel to a horizontal lane when viewed in cross-section as shown in FIGS. 2 and 3.

The walls 38–44 and front and rear walls enclose a coolant jacket adapted to receive liquid coolant for cooling the various parts of each cylinder head 34, 36. For each cylinder location, the cylinder heads 34, 36 carry a number of components including, for example, an injector, intake and exhaust valves associated with the intake ports 50 and exhaust ports 52 (FIG. 1) as well as rocker arms used to move the intake and exhaust valves to open the intake ports 50 and exhaust ports 52. The rocker arms are actuated by push rods connected with spring-biased followers which engage cams on cam shafts driven via other related components by the crankshaft, all of which are conventional and not shown here. Further, the engine 10 also includes a number of other conventional components which are commonly known in the art and will not be described in detail here.

The internal combustion engine 10 also includes a pair of exhaust manifolds 54, 56 mounted to the outer side walls 44 of each of the pair of cylinder heads 34, 36. A single, integrated intake manifold and rocker cover, generally indicated at 58, is mounted to the horizontal upper walls 38 of the pair of cylinder heads 34, 36 and spans the plenum 18 defined by the V-shaped pair of cylinder banks 14, 16. The integrated manifold and rocker cover 58 provides intake air to the cylinders 24 in each of the pair of cylinder banks 14, 16 through the pair of cylinder heads 34, 36. Furthermore, the integrated manifold and rocker cover 58 also recirculates exhaust gas from the pair of exhaust manifolds 54, 56 to each of the cylinders 24 in the cylinder banks 14, 16. To this end, the integrated manifold and rocker cover 58 includes an exhaust gas recirculating (EGR) cooler core, generally indicated at 60, which is removably mounted centrally therein and in fluid communication with the exhaust manifolds 54, 56 via delivery passages 59 located at the upper end of the top view of FIG. 1, for cooling the exhaust gas before it is delivered to the cylinders 24. The EGR cooler core 60 may also include EGR valves, schematically represented at 61 in FIG. 2, and possibly other related components which are not shown. As best shown in FIG. 1, the cylinder heads 34, 36 also include coolant connections 62 interconnecting the coolant jacket (not shown) in the cylinder heads with the EGR cooler core 60. Similarly, the integrated manifold and rocker cover 58 includes coolant passages 64 which communicate between the coolant connections 62 and the EGR cooler core 60. The coolant connections 62 and coolant passages 64 may be located opposite the delivery passages 59, as viewed in FIG. 1.

The integrated manifold and rocker cover 58 also includes a plurality of EGR introduction passages 66 spaced relative to one another and on either side of the EGR cooler core 60. The introduction passages 66 provide fluid communication between the EGR cooler core 60 and a pair of rail manifolds 67 formed in the integrated manifold rocker cover 58 on either side of the EGR cooler core 60. The rail manifolds 67 provide fluid communication between ambient intake air, the EGR cooler core 60 and the intake ports 50 formed in the cylinder heads 34, 36 via intake passages 70. Exhaust passages 72 (FIG. 1) provide fluid communication between the exhaust port 52 and the exhaust manifolds 54, 56.

As illustrated in FIGS. 2 and 3, the integrated intake manifold and rocker cover 58 may also include cooling fins 74 formed on the outer surface thereof to assist in cooling the exhaust gas flowing through channels 76 formed in the manifold (FIG. 2). Further, the coolant connections 62, coolant passages 64, as well as the EGR introduction passages 66 act to minimize noise transmission from the engine to the environment.

The present invention facilitates efficient engine component packaging objectives by combining a single intake manifold 58 for servicing both cylinder banks 14, 16, with a single rocker cover. Accordingly, the present invention eliminates the need for separate intake manifolds, gaskets, EGR cooler housing and certain on-board plumbing associated with externally mounted EGR valves. Further, use of wedge-shaped cylinder heads 34, 36 for a V-block engine provide a substantially horizontal mounting face for the single, integrated intake manifold and rocker cover 58. This structure facilitates the supply of intake air through the intake manifold 58 from above. Further, the wedge-shaped cylinder heads 34, 36 provide vertical access to the intake ports 50 of each cylinder 24. Finally, the integrated intake manifold and rocker cover may be manufactured from a number of materials including aluminum, cast-iron, and even thermoplastics.

Thus, the present invention eliminates a number of components as well as plumbing, gaskets, brackets and fasteners associated with separate intake manifolds for each cylinder head, separate rocker covers and EGR cooling apparatuses. Further, the wedge-shaped cylinder heads 34, 36 also provide added flexibility to optimize intake port geometry with a low loss, top entry intake port 50. Vertical intake air entry into the cylinder heads 34, 36 may be used to achieve additional tumble within the combustion chamber.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. An internal combustion engine comprising:

An engine block having a pair of cylinder banks arranged in V-shaped configuration such that each of the pair of cylinder banks presents a top wall disposed at an acute angle relative to horizontal and a plurality of cylinders disposed spaced from one another and longitudinally aligned within each cylinder bank;

a pair of cylinder heads associated with said pair of cylinder banks, each of said cylinder head including upper and lower walls disposed at a angle relative to each other such that each cylinder head is substantially wedged-shaped in cross-section, said cylinder heads mounted to said engine block such that said lower wall of each cylinder head seals the opposing top wall of the associated cylinder bank so as to close the open ends of said cylinders in such as said upper wall of each of said cylinder heads is substantially parallel to horizontal;

a pair of exhaust manifolds mounted to each of said pair of cylinder heads; and a single, integrated intake manifold and rocker cover mounted to said horizontal walls of said pair of cylinder heads, said integrated manifold and rocker cover providing intake air to said cylinders in each of said pair of cylinder banks through said pair of cylinder heads and recirculating gas from said exhaust manifold to each of said cylinders in said pair of cylinder banks said integrated manifold and rocker cover include an exhaust gas recirculating cooler core removably mounted therein and in fluid communication within said exhaust manifold for cooling exhaust gas before it is delivered to said cylinders.

2. An internal combustion engine as set forth in claim 1 wherein said integrated manifold and rocker cover includes intake passages providing fluid communication between said exhaust gas recirculating cooler cores and a source of intake air and said cylinder.

3. An internal combustion engine as set forth in claim 2 wherein said integrated manifold and rocker cover includes exhaust gas introduction passages providing fluid communication between said exhaust gas recirculating cooler core and said intake passages.

4. An internal combustion engine as set forth in claim 1 wherein said cylinder heads include inner and outer side walls and front and rear walls, all of which extend between said upper and lower walls, said exhaust manifolds mounted to said outer side walls on each of said pair of cylinder heads.

5. An internal combustion engine as set forth in claim 1 wherein said V-shaped configuration of said pair of cylinder banks defines a plenum therebetween, said integrated intake manifold and rocker cover mounted to said horizontal upper walls of said cylinder heads and spans said plenum defined by said V-shaped pair of cylinder banks.

* * * * *